US006171200B1

(12) United States Patent
Camp

(10) Patent No.: US 6,171,200 B1
(45) Date of Patent: Jan. 9, 2001

(54) AMUSEMENT BALL DEVICE WITH RETRACTABLE PROPELLING MECHANISM

(76) Inventor: Richard S. Camp, 125 Oak Ave., San Anselmo, CA (US) 94960

( * ) Notice: Under 35 U.S.C. 154(b), the term of this patent shall be extended for 0 days.

(21) Appl. No.: 09/261,078

(22) Filed: Mar. 2, 1999

(51) Int. Cl.[7] ..... A63H 1/06
(52) U.S. Cl. ..... 473/249; 473/250; 473/576
(58) Field of Search ..... 446/40–42, 236, 446/247–250, 266, 315, 328, 486, 490; 473/575–576

(56) References Cited

U.S. PATENT DOCUMENTS 446,535 * 2/1891 Querbridge .
2,210,024 * 8/1940 Cayo .
2,958,156 * 11/1960 Schmahl .
3,650,530 * 3/1972 Gantz .
4,177,995 * 12/1979 Surland .
4,241,918 * 12/1980 Massino .
4,332,383 6/1982 Milden et al. ..... 273/64
4,601,474 * 7/1986 Lew et al. .
5,127,868 7/1992 Smollar ..... 446/250
5,261,661 * 11/1993 Lemmon .
5,401,034 * 3/1995 Mallinger .
5,476,297 12/1995 Lombard ..... 294/19.2
5,522,757 * 6/1996 Ostrowski .
5,839,577 * 11/1998 Friedler ..... 206/315.1
5,853,339 * 12/1998 Scerbo ..... 473/576
5,888,157 * 3/1999 Guenther et al. ..... 473/604

* cited by examiner

*Primary Examiner*—Kien T. Nguyen
(74) *Attorney, Agent, or Firm*—Fenwick & West LLP

(57) ABSTRACT

A retractable amusement ball device includes a retract assembly. The retract assembly includes a recoil mechanism. A rope or cord is attached to the recoil assembly at one end. The other end of the cord may include a handgrip assembly such as a knob, a ring, or a handle. When the retractable amusement ball device is at rest, the cord is wound about the recoil assembly. The handgrip assembly comes to rest against an exterior of the retractable amusement ball device. When a participant plans to launch the retractable amusement ball device, the participant grips or grabs the handgrip assembly and pulls the cord into an extended position. A force is applied to the ball through the extended cord and handgrip mechanism. When the participant releases the handgrip assembly, the recoil mechanism rewinds the cord back into the retract assembly as the retractable amusement ball device is propelled through the air. By the time the retractable amusement ball device is back at rest, the cord is completely recoiled within the retractable amusement ball device and the handgrip assembly is again at rest against the retractable amusement ball device.

17 Claims, 10 Drawing Sheets

AMUSEMENT BALL DEVICE WITH RETRACTABLE PROPELLING MECHANISM

BACKGROUND OF THE INVENTION

1. Field of the Invention

The present invention relates generally to amusement devices, and more specifically, to an amusement ball having a retractable propelling mechanism.

2. Description of the Related Art

Sales of toys and other amusement devices form a large part of the economy. Some popular amusement devices are conventional ball devices that are propelled or launched through the air by human power. Propelling with human power is conventionally achieveed in one of two methods. In a first method, a conventioral ball device is first physically gripped. Once gripped, the conventional ball device is then launched by using forward momentum of an outward force.

In a second method, the conventional ball device is attached to the end of a rope. The amusement device again first gripped by the rope. Once gripped, the rope is used to twirl the conventional ball device in a circular motion. Using the developed centrifugal force the conventional ball device is released and launched forward. Frequently, the second method produces the furthest throwing results.

Conventional ball devices that can be gripped and then physically launched are known. A problem, however, with these conventional ball devices is that they lack a rope or a cord. The lack of a rope or a cord limits the amount of total force to be applied to the conventional ball device to launch it. This results in limiting or decreasing the distance that the conventional ball device can be propelled.

Conventional ball devices having a rope or a cord attachment that may generate momentum with a circular motion and with the help of centrifugal force be launched are also known. A problem with conventional ball devices having a rope or a cord attachment is that the rope or the cord consistently trails the conventional ball device. The trailing rope increases drag on the conventional ball device. The increased drag clearly hinders the flight of the ball. This results in limiting or decreasing the distance that the conventional ball device can be propelled.

Another problem with conventional amusement devices having a rope or a cord attachment is that the rope consistently flails once it is released. This also increases drag on the ball and results in limiting or decreasing the distance the amusement device can be propelled. The flailing rope also disrupts the aerodynamics of the conventional ball device. More particularly, the flailing rope causes the flight path of the conventional ball device to be altered as the whipping force of the trailing rope causes a shift in the direction of force in which the conventional ball device is propelled. This also reduces the distance the ball can be propelled. Moreover, it reduces the accuracy with which the ball may be directed once it is propelled.

Yet another problem with conventional ball devices having a rope or a cord is that they may be susceptible to causing increased damage in the surroundings where they are propelled. More particularly, the trailing rope may be flaiLing out of control. The trailing and flailing rope causes whip-like forces to be applied to innocent objects and things resulting in damage to those items.

Therefore, there is a need for an amusemnent ball device that may (1) be launched through a rope or a cord and (2) that minimizes or eliminates the application of external forces on the amusement ball device that may unnecessarily hinder the forces to propel the amusement ball device.

SUMMARY OF THE INVENTION

In an embodiment of the present invention, a retractable amusement ball device includes a retract assembly. The retract assembly includes a recoil mechanism. A line or cord is attached to the recoil assembly at one end. The other end of the line may include a handgrip assembly such as a knob, a ring, or a handle.

When the retractable amusement ball device is at rest, the line is wound about the recoil assembly. The handgrip assembly comes to rest against an exterior of the retractable amusement ball device. When a participant plans to launch the retractable amusement ball device, the participant grips or grabs the handgrip assembly and pulls the line into an extended position. A force is applied to the ball through the extended line and handgrip mechanism. For example, a centrifugal force, may be applied by gripping the handgrip assembly and twirling the ball in a circular manner.

When the participant releases the handgrip assembly, the recoil mechanism rewinds the line back into the retract assembly as the retractable amusement ball device is propelled through the air. By the time the retractable amusement ball device is back at rest, the line is completely recoiled within the retractable amusement ball device and the handgrip assembly is again at rest against the retractable amusement ball device.

An advantage of the present invention is that because the line is recoiled back into the retractable amusement ball device, the line is not consistently trailing the retractable amusement ball device. Therefore, the present invention beneficially reduces drag force on the retractable amusement ball device. Further, another advantage of the present invention is that the line is not flailing around as the retractable amusement ball device is propelled. Therefore, the present invention beneficially reduces or eliminates extraneous whipping forces on the retractable amusement ball device. Moreover, the present invention increases aerodynamic capabilities of the retractable amusement ball device, and thereby beneficially increases propulsion distances.

The present invention also allows for a retractable amusement ball device having increased versatility for the propulsion methods. The present invention beneficially allows a participant to grip this device and propel it in a forward motion without it being hindered by a trailing line. In addition, the present invention allows a participant to grip the handgrip device, pull the line from the retract assembly, and launch the retractable amusement ball device with centrifugal force to propel it in a forward motion. The versatility of the present invention beneficially allows a participant to utilize these methods, as well as numerous other methods, without being hindered from one method or the other when propelling the retractable amusement ball device. Some of these methods may also challenge or improve participant dexterity in that more intricately performed propulsion maneuvers can be realized.

The present invention also allows for a variety of unique handgrip assemblies. In addition to, for example, a knob, a ring, or a handle, the handgrip assembly may be, for example, an optical or light assembly or a parachute assembly. This feature beneficially increases the number of configurations that the ball amusement device may be assembled into, and therefore, increases the number and variety of activities for which the retractable amusement ball device can be used.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

DETAILED DESCRIPTION OF THE PREFERRED EMBODIMENTS

The figures depict a preferred embodiment of the present irivention for purposes of illustration only. One skilled in the art will readily recognize from the following discussion that alternative embodiments of the structures and methods ilhlstrated herein may be employed without departing from the principles of the claimed invention.

Figure 1:
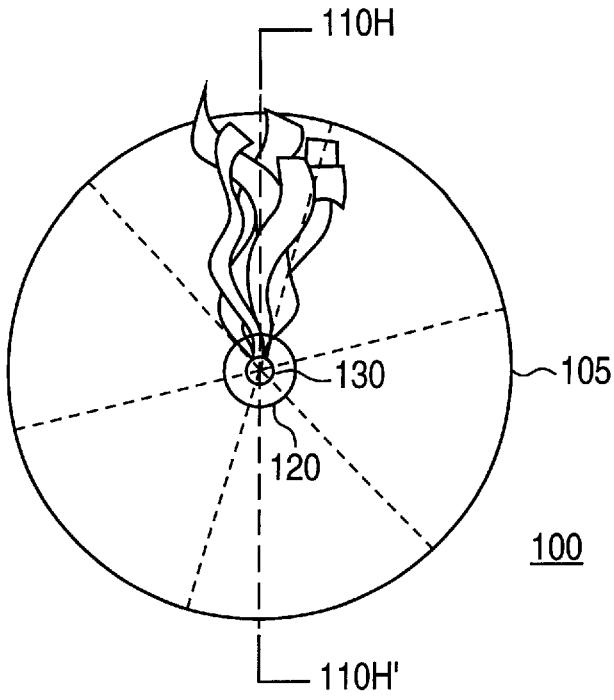
FIG. 1 illustrates an end view perspective of one embodiment of a retractable amusement ball device in accordance with the present invention.

FIG. 1 illustrates an end view perspective of one embodiment of a retractable amusement ball device 100 in accordance with the present invention. The retractable amusement ball device 100 includes a ball or ball assembly 105 and a handgrip assembly 130. The ball assembly 105 includes an outer surface or outer portion that may be comprised of a cover material 140. The ball assembly 105 also includes an inner portion that may be comprised of a filler material.

It is noted that in a first embodiment the ball assembly 105 is comprised of an outer cover material and an inner filler material. The cover material may be any soft and/or pliable material, for example, a cloth material, a vinyl material, a leather material, a pliable plastic material, a rubber or rubber-like material, or the like, including any combination of such soft and/or pliable material. The filler material may be any material that the cover material can cover. The filler material may be, for example, a cloth or cloth pieces material, a vinyl material, a leather material, a foam material, a Styrofoam™ material, a balloon material that can be filled with a gas or a liquid, a pliable plastic material, or the like, including any combination of filler material that the cover material can cover. The cover over the filler material may be attached in any manner, for example, stitching, tacking, adhesive, pins, staples, rivets, or the like.

In a second embodiment, the ball assembly 105 is comprised of a cover material that is hardened. In the second embodiment of the ball assembly 105, the cover material can be, for example, a Styrofoam™ material, a hard plastic material, a wood material, a metallic material, or the like, including any combination of a cover material that is hardened. In the second embodiment, the filler material can be any filler material that can be used to fill an inner portion of the ball assembly 105, including, but not limited to, gas, liquid, or a material or materials that can be used as a packing material.

In a third embodiment, the ball assembly 105 is comprised completely or substantially completely of a solid pliable material. The solid pliable material may be, for example, a pliable foam material, a pliable polyurethane, a rubber or rubber-like material, or the like, including any combination of solid pliable materials.

In a fourth embodiment, the ball assembly 105 is comprised completely or substantially completely of a solid material. The solid material may be, for example, a metallic substance, a wood substance, a hard plastic substance, or the like, including any combinations of solid materials.

Turning to the handgrip assembly 130, in a first embodiment the handgrip assembly 130 is a knob or knob-like structure. In a second embodiment the handgrip assembly 130 is a handle or handle-like structure. In a third embodiment, the handgrip assembly 130 is a gripping type structure. The gripping type structure includes any structure that can be gripped in some manner, for example, by a hand, a finger or fingers, or the like. In a fourth embodiment, the handgrip assembly 130 is a grasping type structure The grasping type structure includes any structure that can be grasped in some manner, for example, a hand, a finger or fingers or the like. The grasping structure may also be mechanical, for example, a clip, a robot arm, a release mechanism that grasps the assembly and releases at some instance, or the like. The handgrp assembly 130 may be constructed of any soft or rigid structure, for example, cloth, leather, vinyl, nylon, acrylonitrile-butadiene-styrene (ABS), plastic, metal, or the like.

One end of the handgrip assembly 130 couples to a line (not shown). A first end of the line is disposed within an interior of the ball assembly 105 as is further described below. A second end of the line couples to one end of the handgrip assembly 130. The handgrip assembly 130 comes to rest against an outer surface of the ball assembly 105 when the handgrip assembly 130 is in a rest position.

Referring back to the retractable amusement ball device 100, in one embodiment the retractable amusement ball device also includes a grommet 120. The grommet 120 couples to the ball assembly 105 so that it comes to rest against the outer surface of the ball assembly 105 or just within the interior of the ball assembly 105. In this embodiment of the retractable amusement ball device 100, the one end of the handgrip assembly 130 comes to rest against the grommet 120 rather than the outer surface of the ball assembly 15.

In an alternative embodiment, the grommet 120 has a concave structure. The grommet 120 with a concave structure has one end relatively flush with respect to the outer surface of the ball assembly 105 and the other end slightly recessed below the outer surface of the ball assembly 105, for example, slightly within the interior of the ball assembly. In this embodiment the concavity of the grommet 120 is sufficient so that a substantial portion of the handgrip assembly 130 is within the concave area when the handgrip assembly 130 is in a rest position 220*a*. When the handgrip assembly 130 is in the rest position 220*a* against the grommet 120, they are as a unit substantially flush with respect to the outer surface of the ball assembly 105.

It is noted that the grommet 120 may be comprised of any soft or hard material. The grommet 120 may be comprised of, for example, a Styrofoam™ material, a pliable plastic material, a hard plastic material, a foam material, a pliable foam material, a rubber or rubber-like material, ABS, or the like.

Figure 2:
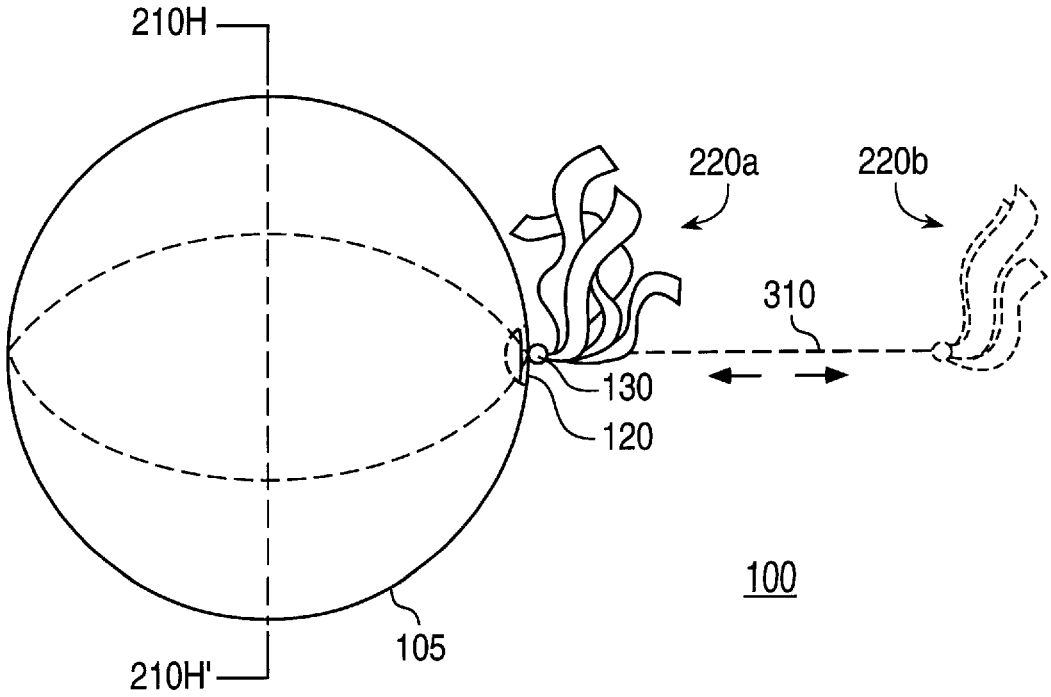
FIG. 2 illustrates a side view perspective of one embodiment of a retractable amusement ball device in accordance with the present invention.

FIG. 2 illustrates a side view perspective of one embodiment of the retractable amusement ball device 100 in accordance with the present invention. The retractable amusement ball device 100 includes the ball assembly 105, the grommet 120, a line 310, and the handgrip assembly 130. It is noted that the line 310 may be any flexible or rigid line. The line 310 may be, for example, a rope, a string, a wire, a cord, a chain, or the like.

A first end of the line 310 is disposed within the ball assembly 105. A second end of the line 310 couples to the handgrip assembly. It is noted that the line 310 is illustrated in FIG. 3, but is shown in FIG. 2 as a dashed line to indicate that the line may extend from within the ball assembly 105. The line 310 passes through the grommet 120 if the grommet 120 is present. The grommet 120 couples with the ball assembly 105 so that at least a portion of it rests against the surface of the ball assembly 105.

Figure 3A:
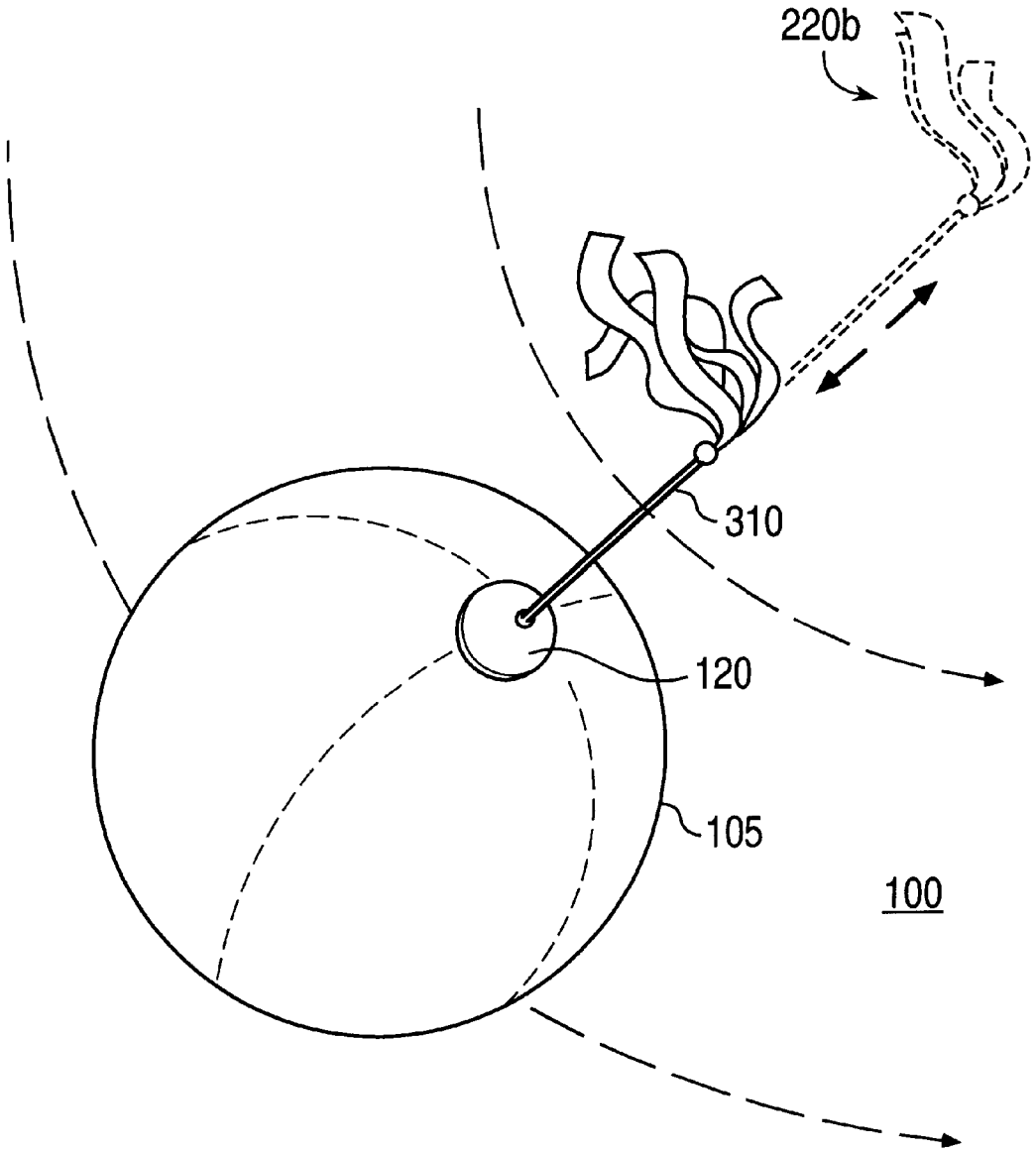
FIG. 3*a* illustrates an axonometric view of a retractable amusement ball device in an executing position in accordance with the present invention.
Figure 3B:
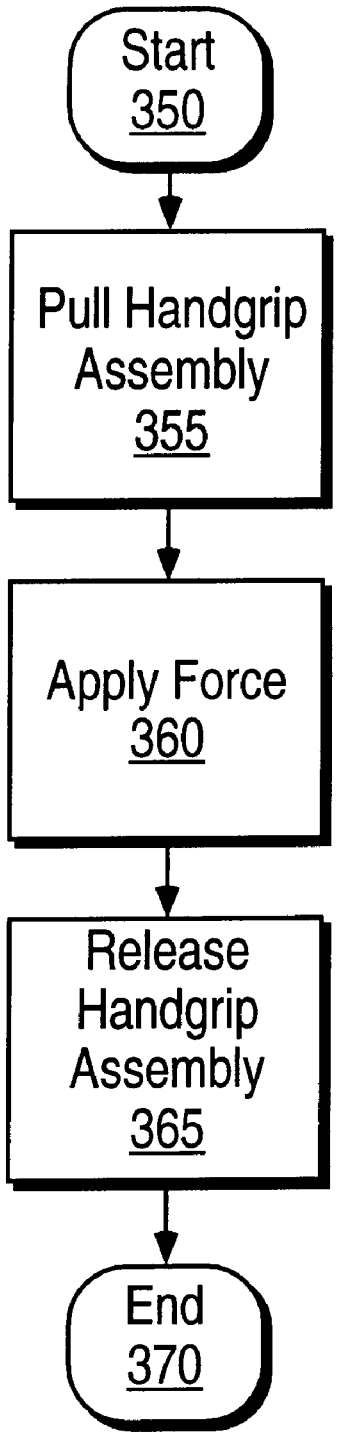
FIG. 3*b* illustrates a flow chart of one embodiment of a general process for using the retractable amusement ball device in accordance with the present invention.

To a limited extent, FIG. 2 illustrates the retractable amusement ball device 100 in both a rest position and an executing (or extended) position 220*b* in accordance with the present invention. FIG. 3*a* illustrates an axonometric view of a retractable amusement ball device 100 in the extended position 220*b* in accordance with the present invention. FIG. 3*b* is a flow chart illustrating one embodiment of a general process for using the retractable amusement ball device, for example, as illustrated in FIGS. 2 and 3*a*.

Generally, in one embodiment at the start 350 a user (or player) may use (or executes) the retractable amusement ball device 100 by first grabbing the handgrip assembly 130. The user pulls 355 the handgrip assembly 130 away from the rest position 220*a* so that a line from the interior of the retractable amusement ball device 100 is now in an extended position 220*b*. The user may apply 360 a force (a momentum) on the retractable ball device using the handgrip assembly 130 in the extended position. For example, the user may use the handgrip assembly 130 in the extended position to whirl the retractable amusement ball device 100. When the user releases 365 the retractable amusement ball device 100, the line retracts or recoils back into the interior of the retractable amusement ball device 100. The line continues to retract until the handgrip assembly 130 returns back (end 370) to the rest position 220*a* against the surface of the ball assembly 105 or the grommet 120.

Figure 4:
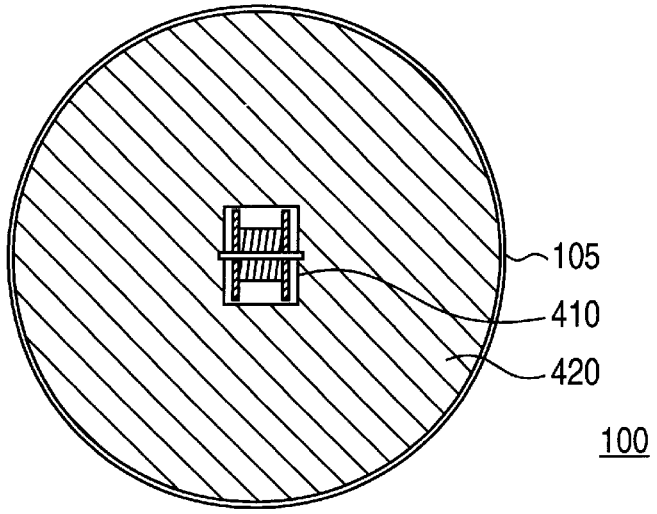
FIG. 4 illustrates a cross-sectional view from the end perspective of a retractable amusement ball device having a retract assembly in accordance with the present invention.

FIG. 4 illustrates a cross-sectional view from the end perspective of a retractable amusement ball device 100 having a retract assembly 410 in accordance with the present invention. The cross-sectional view is through a center axis 210H, 210H' as illustrated in FIG. 2. The cross-sectional view illustrates an embodiment of the retractable amusement ball device 100 having an interior portion 420. The interior portion 420 may be, for example, the filler material encompassed by the cover material described above. The interior portion 420 may also be, for example, the solid material or the solid pliable material described above. Preferably, the retract assembly 410 is disposed to the interior portion 420 of the ball assembly 105 at a center (or substantially at the center). Alternatively, the retract assembly is disposed within another location in the interior portion 420 of the ball assembly 105.

Figure 5:
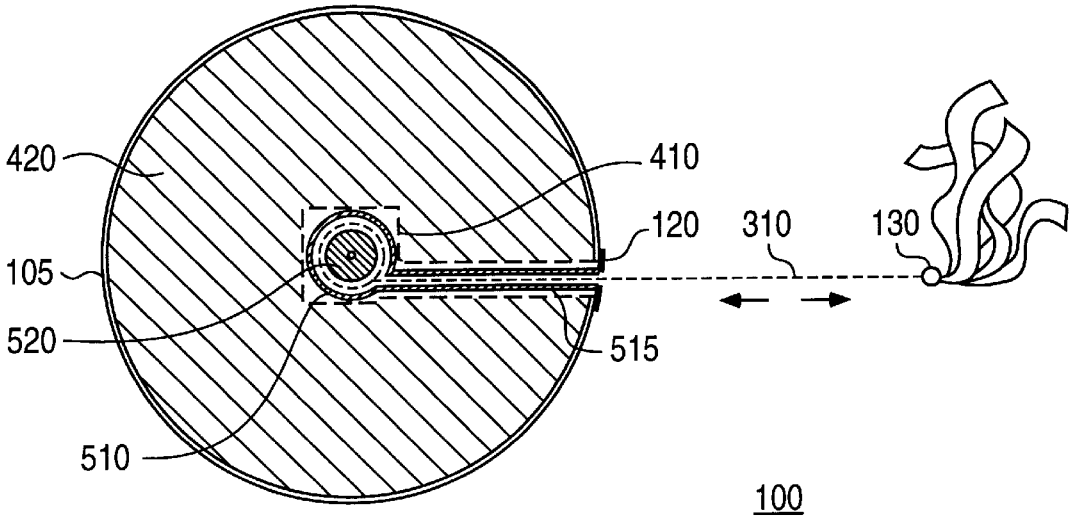
FIG. 5 illustrates a cross-sectional view from the side view perspective of the retractable amusement ball device having the retract assembly in accordance with the present invention.

FIG. 5 illustrates a cross-sectional view from the side view perspective of the retractable amusement ball device 100 having the retract assembly 420 in accordance with the present invention. The cross-sectional view is through a center axis 110H, 110H' as illustrated in FIG. 1. The retractable amusement ball device 100 includes the ball assembly 105, including the interior portion 420, the retract assembly 410, the line 310, the handgrip assembly 130, and the grommet 120.

The retract assembly 410 includes a retract assembly housing 510, a flange portion 515 of the retract assembly housing, and a recoil mechanism 520. It is noted that in one embodiment the housing 510 includes the flange portion 515 and is a single piece unit. The retract assembly and its components, including the housing 510 and the flange portion 515, may be comprised of a substantially rigid material, for example, plastic, metal, Styrofoam™, ABS, or the like. It is also noted that in another embodiment, the housing 510 may include the flange portion 515 and the grommet 120 so that all three portions comprise a single unit. In yet another embodiment, the flange 515 and the grommet 120 may be a single piece unit.

The recoil mechanism 520 may be a conventional recoil or retract mechanism that includes a spool. The spool allows the line 310 to be wound about it at the first end side of the line 310. The recoil mechanism 520 also allows the line 310 to be unwound when the first end of the line 310 is pulled and then allows the line to be automatically wound about it when the second end of the line 310 is released.

In a preferred embodiment, retract assembly 410 is disposed within the center (or substantially center) of the interior portion 420 of the ball assembly 105. The housing 510, including the flange 515, couples with the grommet 120 at the outer surface or just below the outer surface of the ball assembly 105, depending on whether grommet 120 is concave. The grommet 120 couples to the ball assembly 125 so that a portion of it is at rest against the outer surface of the ball assembly 105. The first end of the line 310 couples to the spool and the remainder of the line 310 is wound about the spool. The second end of the line 310 passes through the flange 515 and the grommet 120 and couples to the handgrip assembly 130.

Figure 6:
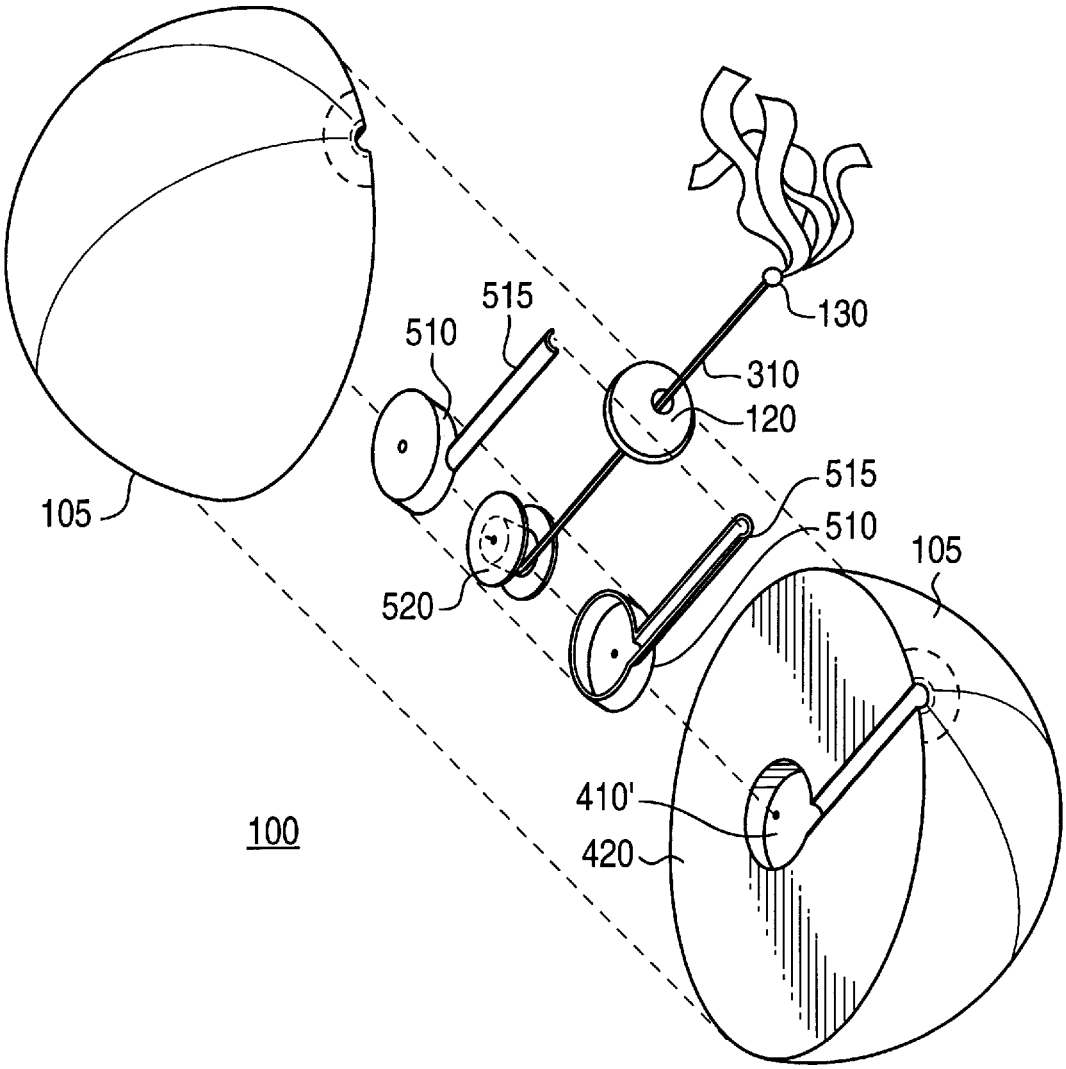
FIG. 6 illustrates an exploded axonometric view of the retractable amusement ball device having the retract assembly in accordance with the present invention.

FIG. 6 illustrates an exploded axonometric view of one embodiment of the retractable amusement ball device 100 having the retract assembly 410 in accordance with the present invention. The retractable amusement ball device 100 includes the ball assembly 105, the retract assembly 410, the line 310 and the handgrip assembly 130. The retract assembly is illustrated with a single piece housing 510 that includes the flange 515. The line 310 is wound about the recoil mechanism at the first end side, passes through the grommet 120 and couples with the handgrip assembly 130 as the second end.

This embodiment also illustrates the retractable amusement ball device 100 having for the interior portion 420 the pliable solid material or the solid material as described above. The embodiment includes a cavity 410' that is shaped such that the retract assembly 410 may be disposed within a cavity 410' itself. This allows the retract assembly 410 to be secured within the interior portion 420 of the ball assembly 105.

Figure 7A:
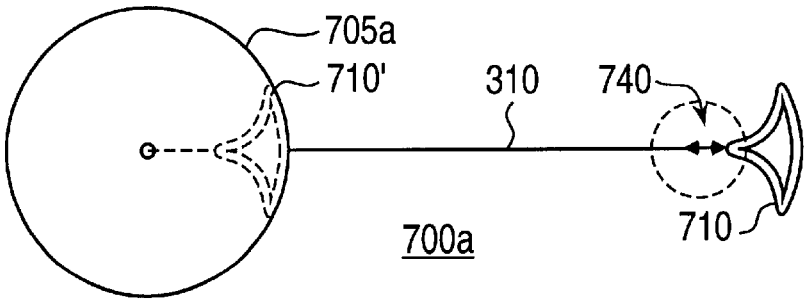
FIGS. 7*a*, 7*b,* and 7*c* illustrate alternative embodiments of a retractable amusement ball device that may be coupled to different handgrip assemblies, for example, a streamer, parachute handle assembly, or a ring or handle in accordance with the present invention.
Figure 7B:
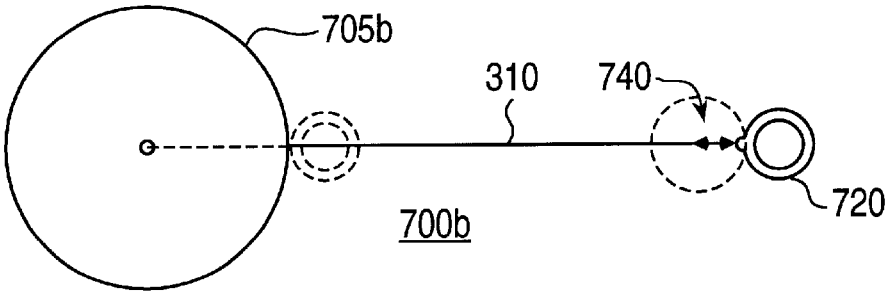
Figure 7C:
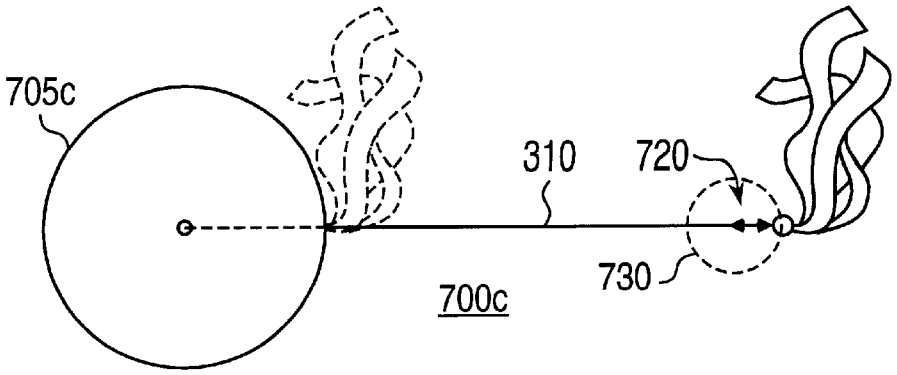
FIGS. 7*d*(1) and 7*d*(2) illustrate a first embodiment and a second embodiment for a locking assembly to couple a handgrip assembly to a second end of a line in accordance with the present invention.

FIGS. 7*a*, 7*b*, and 7*c* illustrate other embodiments of a retractable amusement ball device 100 that couple to different types of handgrip assemblies 130. For example, FIG. 7*a* illustrates an embodiment of a retractable amusement ball device 700*a* having a ball assembly 705*a* and a parachute assembly 710. The ball assembly 705*a* is functionally similar to the ball assembly 105 described above. The parachute assembly 710 couples with the line 310 through a locking assembly 740. In addition, the ball assembly includes a cavity 710' in which the housing of the parachute assembly 710 can rest when it is in the resting position.

The parachute assembly 710 includes a parachute housing. The parachute housing may be used finctionally similar to the handgrip assembly 130 described above with regard to the application of a force when a user executes use of the ball. The parachute assembly 710 opens when the user releases the parachute assembly. As tile retractable amusement device 700*a* floats to a landing, the line 310 recoils the opened parachute so that it comes to rest substantially within the cavity of the ball assembly 705*a*.

In another example, FIG. 7*b* illustrates an embodiment of a retractable amusement ball device 700*b* having a ball assembly 705*b* and a knob or handle 720. The ball assembly 705*b* is functionally similar to the ball assembly 105 described above. The knob or handle 720 is finctionally similar to the handgrip assembly 130 described above. The knob or handle 720 couples to the line 310 through the locking assembly 740. The ball assembly 705*b* may include a cavity in which the knob or handle 720 call rest when in the resting position.

In another example, FIG. 7*c* illustrates an embodiment of a retractable amusement ball device 700*c* having a ball assembly 705*c* and a streamer knob 730. The ball assembly 705*c* is finctionally similar to the ball assembly 105 described above. The streamer knob 730 is finctionally similar to the handgrip assembly 130 described above. The streamer knob 730 couples to the line 310 through the locking assembly 740. The ball assembly 705*c* may include a cavity in which a small knob portion of the streamer knob 730 can rest when it is in the resting position.

Figures 1, 7D:
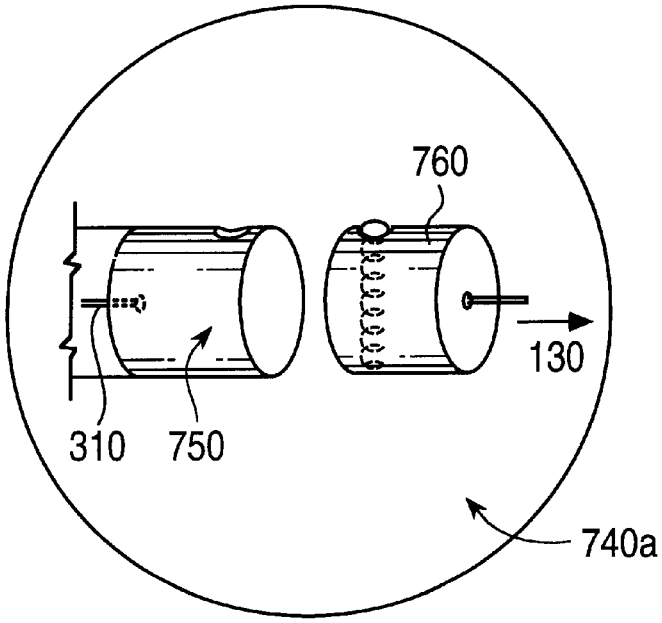
Figures 2, 7D:
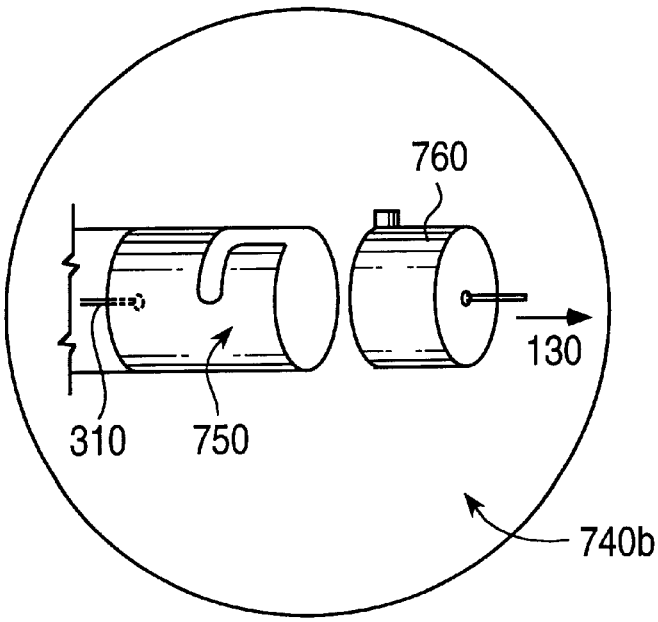

FIGS. 7*d*(1) and 7*d*(2) illustrate a first embodiment 740*a* and a second embodiment 740*b* for a locking assembly to couple the handgrip assembly 130 to the second end of the line 310 in accordance with the present invention. Both the first embodiment 740*a* and the second embodiment 740*b* of the locking assembly 740 include a first portion 750 and a second portion 760. The second end of the line 310 couples with the first portion 750 of the locking assembly 740*a*, 740*b* (generally 740). The handgrip assembly 130 couples with the second portion 760 of the locking assembly 740.

The first portion 750 of the locking assembly 740 may be, for example, a female assembly component, and the second portion 760 of the locking assembly 740 may be, for example, a male assembly component, or vice versa. Further, the first embodiment of the locking assembly 740*a* may include an L-shaped groove on the first portion and a protrusion from the second portion. To couple the locking assembly 740*a*, the protrusion is slid through the straight portion of the groove and is rotated ninety degrees (or thereabouts) into the slot portion of the groove.

The second embodiment of the locking mechanism 740*b* may include a small hole in the first portion and a spring or spring type protrusion on the second portion. To couple the locking assembly 740*b*, the second portion is fit through the first portion so that the spring is lowered. When the protrusion is over the hole, the spring pops the protrusion into the hole. To release, a release mechanism can be used to re-lower the spring and pull apart the two portions of the locking mechanism 740*b*.

Figure 8:
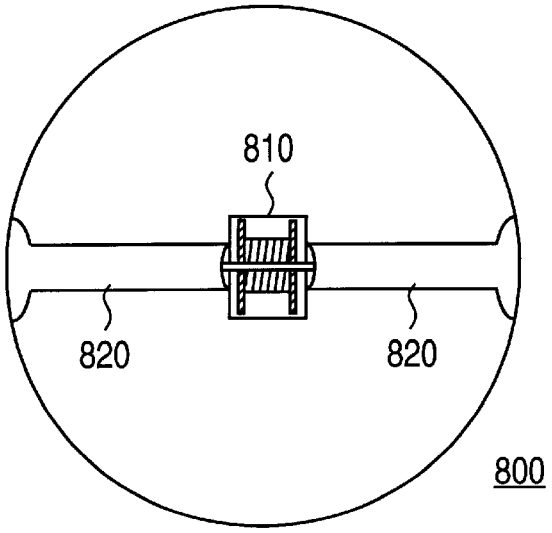
FIGS. 8 and 9*a*–9*c* illustrate additional alternative embodiments of a retractable amusement ball device having a retract assembly in accordance with the present invention.

FIG. 8 illustrates an embodiment of a hollowed retractable amusement ball device 800 in accordance with the present invention. The hollowed retractable amusement ball device 800 includes a ball assembly 805, a retract assembly 810, and a first and a second retract assembly support 820. The retract assembly 810 is functionally similar to the retract assembly 410 described above. The first and the second retract assembly support 820 are comprised of a structurally rigid material. The ball assembly 805 is comprised of a cover material that may also be a structurally rigid material. The interior of the ball assembly 805 is substantially hollowed.

The first and the second retract assembly supports 820 couple to the retract assembly 810 and to the interior wall of the ball assembly 805. The cover material of the ball assembly 805 need only be sufficiently rigid to support the first and the second retract assembly support 820. The retract assembly 805 is positioned so that its flange allows the second end of the line 310 to protrude from the ball assembly 805 and couple to the handgrip assembly 130.

Figure 9A:
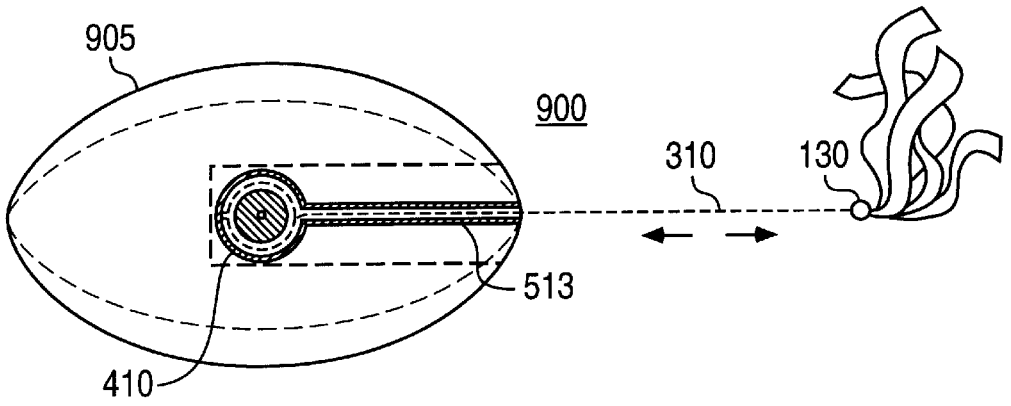

It is noted that the ball assembly described above, e.g., ball assembly 105, is generically portrayed as a spherical-like structure. One skilled in the art will understand that the ball assembly may be of other regular (e.g., a pyramid) and irregular three-dimensional (e.g., trapazoidal) shapes without departing from the spirit of the invention. For example, FIG. 9*a* illustrates another embodiment of a retractable amusement ball device 900 in accordance with the present invention. The retractable amusement ball device 900 includes a ball assembly that is an American football-like structure 905. Similar to the ball-assembly 105 described above, the retract assembly 410 is located in the interior of the American football-like structure 905. The flange 513 of the retract assembly 110 is disposed such that the line 310 may be pulled form one point end of the American football-like structure 905.

Figure 9B:
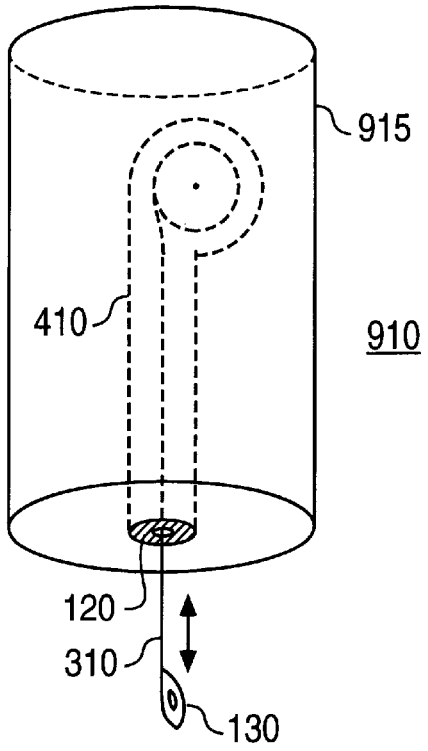
Figure 9C:
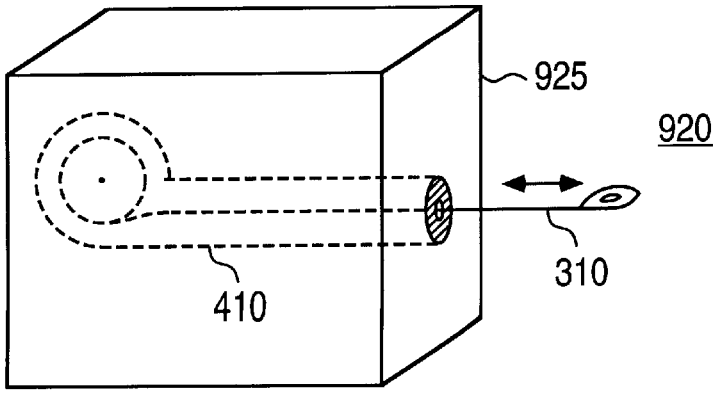

FIG. 9*b* illustrates still another embodiment of a retractable amusement ball device 910 in accordance with the present invention. In this embodiment the retractable amusement ball device 910 includes a ball assembly that is a cylinder-like structure 915. Similar to the ball assembly 105 described above, the retract assembly 410 is located in substantially a center of the interior of the cylinder-like structure 915. The flange 510 of the retract assembly 410 is disposed such that the line 310 may be pulled from an end of the cylinder-like structure 915. FIG. 9*c* illustrates yet another embodiment of a retractable amusement ball device 920 includes a ball assembly that is a cube-like structure 925 having the retract assembly 410 located in substantially a center of the interior.

Figure 10A:
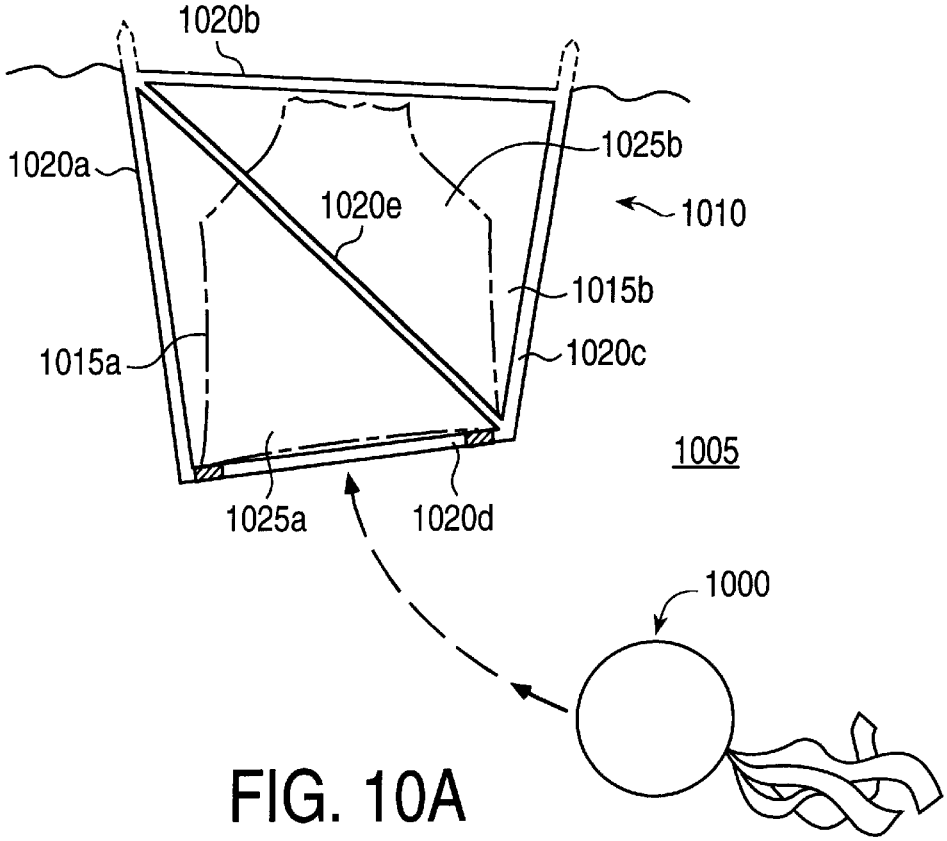
FIGS. 10*a* and 10*b* illustrate embodiments of an amusement game using a retractable amusement ball device in accordance with the present invention.
Figure 10B:
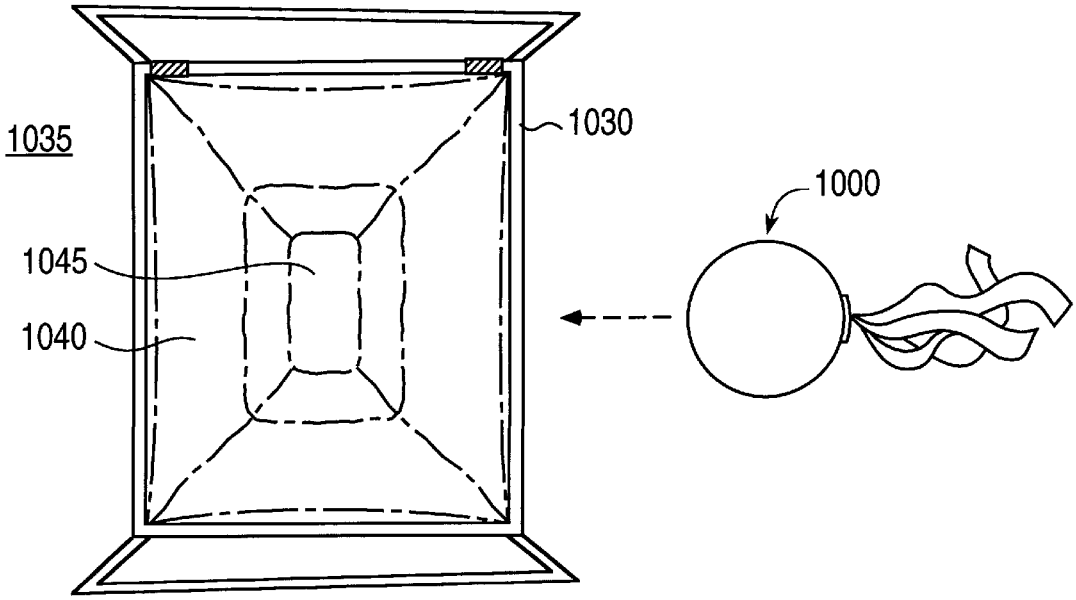

FIGS. 10*a* and 10*b* illustrate two embodiments of an amusement game system using a retractable amusement ball device 1000 in accordance with the present invention. The retractable amusement ball device 1000 is functionally equivalent to the retractable amusement ball device 100. A first embodiment of an amusement game system 1005 includes a basket assembly 1010 divided into two or more compartments, e.g., 1015*a*, 1015*b*. In one embodiment, the basket assembly 1010 is comprised of individual rods, e.g., 1020*a*–1020*e*, that are assembled to create the compartments. The rods may be comprised of any rigid material, for example, metallic pipes, wood dowels, or plastic tubes. In an alternative embodiment, the basket assembly 1010 structure comprises a single piece unit.

In addition, the basket assembly 1010 also includes a net, e.g., 1025*a*, 1025*b*, that couples to each compartment to form a basket for that compartment. A line or adhesive may be used to couple the net to each compartment. Alternatively, a single net that couples with all the compartments may be used. In yet another embodiment, each compartment may be formed by having a solid wall separate each compartment, e.g., 1025*a*, 1025*b*.

One embodiment of the amusement game system 1005 may be played by one user or multiple users, either individually or in teams. In one embodiment, at the onset of a game, each compartment may be pre-assigned to a user or a team. In addition, in one embodiment, an object of the game is to have the retractable amusement ball device 1000 be placed in the user's or team's pre-assigned compartment or basket. Each time the ball is placed in the pre-assigned compartment, this results in a score of points that is predetermined at the onset. The game may continue until an overall score of a number of points is re ached. This overall score may also be predetermined at the onset of the game. The basket system 1010 may be placed horizontally (parallel to the ground) or vertically (perpendicular to the ground).

To play the amusement game device, a user is placed at a predetermined distance away from the basket system 1010. Using the retractable amusement ball device 1000, the user uses a handgrip assembly of the amusement ball device 1000 to generate a momentum on the ball device 1000. The user then takes aim at the predetermined compartment that may be assigned to that user. When the user is ready, the user releases the handgrip assembly at such time so that the retractable amusement ball device 1000 can fall within the predetermined compartment. If the retractable amusement ball device 1000 falls into the predetermined compartment, the user earns the predetermined number of points for this "basket." The amusement game system 1005 continues until the overall predetermined number of points is scored by at least one user or team.

FIG. 10*b* illustrates a second embodiment of an amusement game system 1035 using the retractable amusement ball device 1000 in accordance with the present invention. The second embodiment of the amusement game system 1035 includes a target system 1030. The target system 1030 may be structurally similar to the basket system 1010. For example, the frame may be comprised of a single rigid member or two or more rigid members. In addition, an interior may be comprised of a single net or bask(t or two or more nets. Alternatively, the interior may be comprised of two or more compartments in which each compartment is separated by a solid wall.

In one embodiment the compartments of the target system 1030 interior 1040 may be structured conceptually similar to, for example, a dartboard target or a bow-and-arrow target, with the highest number of points for the retractable amusement ball device 1000 thrown in the middle 1045 and lesser points for the retractable amusement ball device 1000 landing farther away from the middle 1045. When playing the game, the target system 1030 may also be placed horizontally or vertically. To play the game, a user is placed at a predetermined distance away from the target system 1030. Using the retractable amusement ball device 1000, the user uses a handgrip assembly of the amusement ball device 1000 to generate a momentum on the ball device 1000. The user then takes aim at the target system 1030 and releases the handgrip assembly at such time so that the retractable amusement ball device 1000 can hit within the interior 1045 of the target system 1030. The user scores points based on where the ball lands within the interior 1045 of the target system 1030. This game also may be played individually or in teams.

The present invention provides a retractable amusement ball device that uses a handgrip assembly that couples with a line that is wound within a ball assembly. The present invention beneficially allows for the line to be unwound using the handgrip assembly. The present invention also allows for an application of a momentum force on the retractable amusement ball device as the line is in the unwound position. When the handgrip assembly is released, the amusement ball device is projected over some distance. Moreover, when the handgrip assembly is released, the line beneficially recoils into the ball assembly. The present invention may also be advantageously applied to a number of unique games.

While particular embodiments and applications of the present invention have been illustrated and described, it is to be understood that the invention is not limited to the precise construction and components disclosed herein and that various modifications, changes and variations which will be apparent to those skilled in the art may be made in the arrangement, operation and details of the method and apparatus of the present invention disclosed herein without departing from the spirit and scope of the invention as defined in the appended claims.

What is claimed is:

1. An amusement ball device comprising:

a ball having an outer portion and an inner portion;

a retract assembly including a line having a first end, the retract assembly within the inner portion of the ball and the first end of the line located substantially towards the outer portion of the ball when in a resting position; and a handgrip assembly, having a first part and a second part, ihe first part coupled to the first end of the line, wherein the second part of the handgrip assembly is used to extend the line in a direction away from the ball and is positioned substantially flush with the outer portion of the ball when the line is substantially within the inner portion of the ball.

2. The amusement ball device in claim 1, wherein the retract assembly comprises a recoil mechanism having a line spindle, the line wound about the spindle in the resting position, the recoil assembly for rewinding the line back into the resting position in response to the handgrip assembly being released after extending the line in the direction away from the ball.

3. The anusement device in claim 1, wherein the outer portion of the ball comprises a cover material.

4. The amusement device in claim 3, wherein the inner portion of the ball comprises a filler material.

5. The amusement device in claim 1, wherein the ball comprises a soft solid material.

6. The amusement device in claim 1, wherein the inner portion of the ball is hollow and at least one retract assembly support couples the retract assembly to an inner surface of the ball.

7. The amusement device in claim 1, wherein the first end of the line includes a first portion of a locking assembly and the handgrip assembly includes a second portion of a locking assembly, the first portion of the locking assembly for releasably coupling with the second portion of the locking assembly.

8. The amusement device in claim 7, wherein the handgrip assembly includes a parachute assembly.

9. The amusement device in claim 1, wherein the handgrip assembly comprises a knob element.

10. The amusement device in claim 1, wherein the handgrip assembly comprises a handle.

11. A method for propelling an amusement ball device, the amusement ball device having a handgrip assembly on an exterior of the amusement ball device and a retract assembly in an internal to the amusement ball device including a line in a contracted position within the retract assembly, the line coupled with the handgrip assembly, the method comprising:

gripping the handgrip assembly;

pulling the line from the contracted position to an extended position;

generating a force on the amusement ball device through the handgrip and the line in the extended position;

releasing the handgrip assembly; and recoiling the line from the extended position back into the contracted position as the amusement ball device is propelled, wherein the handgrip assembly is positioned substantially flush with the exterior of the amusement ball device when the line is in the contracted position.

12. The method for propelling the amusement ball device in claim 11, wherein the line in the contracted position comprises the line wound around a spindle in the retract assembly and wherein pulling the line comprises unwinding the line from around the spindle.

13. The method for propelling the amusement device in claim 12, wherein recoiling the line further comprises winding the line back around the spindle.

14. An amusement ball device comprising:

a ball having an outer portion and an inner portion;

a retract assembly including a line having a first end, the retract assembly within the inner portion of the ball and the first end of the line located substantially towards the outer portion of the ball when in a resting position; and a handgrip assembly, coupled to the first end of the line and resting against the outer portion of the ball, for extending the line in a direction away from the ball, wherein the first end of the line includes a first portion of a locking assembly and the handgrip assembly includes a second portion of a locking assembly, the first portion of the locking assembly for coupling with the second portion of the locking assembly, and wherein the handgrip assembly includes a parachute assembly.

15. The amusement ball device in claim 14, wherein the retract assembly comprises a recoil mechanism having a line spindle, the line wound about the spindle in the resting position, the recoil assembly for rewinding the line back into the resting position in response to the handgrip assembly being released after extending the line in the direction away from the ball.

16. The amusement ball device in claim 14, wherein the inner portion of the ball comprises one from the group of a filler material and being hollow and having at least one retract assembly support couple with the retract assembly to an inner surface of the ball.

17. The amusement ball device in claim 14, wherein the outer portion of the ball comprises a cover material.

* * * * *